United States Patent [19]

Riniker

[11] Patent Number: 4,606,520

[45] Date of Patent: Aug. 19, 1986

[54] SOAP HOLDER

[76] Inventor: Walter J. Riniker, 1059 Aileen St., Lafayette, Calif. 94549

[21] Appl. No.: 598,862

[22] Filed: Apr. 11, 1984

[51] Int. Cl.[4] ..... A47B 91/00

[52] U.S. Cl. ..... 248/121; 248/359

[58] Field of Search ..... 248/121, 359 R, 359 J, 248/359 G, 359 E, 359 I, 359 D, 359 B, 359.1, 317, 360; D6/532, 533; D30/13; 252/90, 91, 93

[56] References Cited

U.S. PATENT DOCUMENTS

| | | | |
|---|---|---|---|
| 563,635 | 7/1896 | Wiseman | 248/317 |
| 2,679,709 | 6/1954 | Bois | 248/359 B |
| 2,717,472 | 9/1955 | Wilmington | 248/206.2 |
| 3,029,547 | 4/1962 | Ross et al. | 248/359 B |
| 3,380,699 | 4/1968 | Fumat | 248/359 R |
| 3,693,923 | 9/1972 | Ayoub et al. | 248/317 |

FOREIGN PATENT DOCUMENTS

| | | | |
|---|---|---|---|
| 0025015 | 11/1901 | France | 248/359 J |
| 0713377 | 10/1931 | France | 248/359 J |
| 0317014 | 10/1956 | Switzerland | 248/317 |

*Primary Examiner*—Ramon O. Ramirez

*Attorney, Agent, or Firm*—Flehr, Hohbach, Test, Albritton & Herbert

[57] ABSTRACT

A soap holder is disclosed comprising a cylindrical base, a cap portion, and an extended flexible arm which cooperates with a hook or the like embedded in a bar of soap. By standing the holder which is constructed of a heavy material on the edge of a bath or basin, the arm projects out over the water exposing the soap to the air and keeping the soap within easy reach.

4 Claims, 3 Drawing Figures

SOAP HOLDER

This invention relates generally to a soap holder, and more particularly to the design of the device for hanging a cake of soap in such a manner as to permit the entire outside area to be exposed to air for the purpose of drying it.

A problem of long standing to home owners and for which many solutions in the past have been proposed arises because of the affect of water on a cake of soap. It is well known that a cake of soap which stands in water becomes soft, and that the soft portion is almost entirely wasted. Therefore it has become the practice to provide soap dishes with a grid or parallel ribs on the lower surface to support a bar of soap above the bottom. Such devices are partially successful, but tend to entrap soap and water in such a fashion as to cause them to lose their effectiveness.

In partial response to this, some hanging soap holders have been previously devised such as shown for example in U.S. Pat. No. Des. 21,056 which includes a base and a curved arm extending up and over the base with the end centered over the base to support a hanging bar of soap. Such devices however typically occupy a considerable amount of space; in today's smaller bathrooms, such space on a wash stand or side of bathtub is typically not available. Other inventors have proposed soap hangers such as found in U.S. Pat. No. 3,693,923. However, such hangers have entailed driving screws or nails into the wall which most home owners are loath to do because of the damage to the waterproof surface, especially if the soap holder is to be moved.

It is therefore an object of the present invention to provide improved soap holder.

It is a further object of the invention to provide a soap holder which will support a cake of soap in a manner which frees the entire outside surface of the cake of soap to the air for drying.

It is another object of the present invention to provide a soap holder which is portable but occupies a minimum of space on the side of a tub or sink.

The present soap holder comprises a cylindrical base, a cap portion, and an extended flexible arm which cooperates with a hook or the like imbedded in a bar of soap. By standing the holder which is constructed of a heavy material on the edge of a bath or basin, the arm projects out over the water exposing the soap to the air and keeping the soap within easy reach.

Further objects and advantages of the present invention will be apparent from consideration of the following specification and the accompanying drawings in which.

Figure 1:
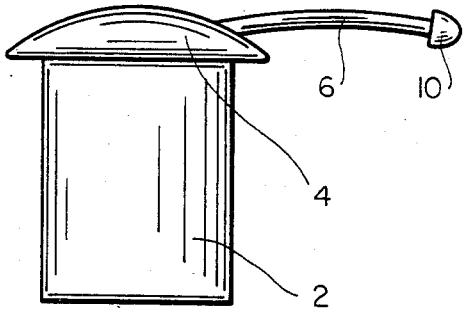
FIG. 1 is a vertical plan view of the soap holder of the present invention.
Figure 2:
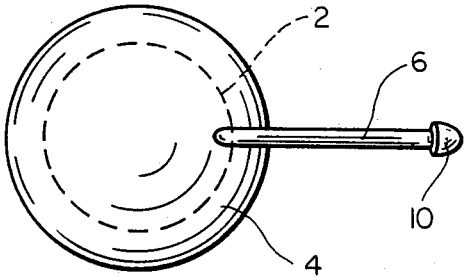
FIG. 2 is a top view of the soap holder of the soap holder.
Figure 3:
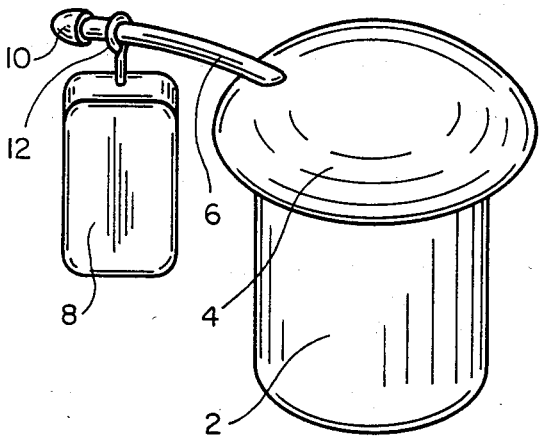

FIG. 3 shows in perspective view the soap holder of the present invention, comprising a base portion 2, a cap portion 4 and an arm 6 from which the soap 8 which is not an integral part of this invention can be hung.

Devices for hanging soap by incorporation in a bar of soap are well known: such devices as in U.S. Pat. No. 843,330 or U.S. Pat. No. 4,062,792 are incorporated herein by reference. The base portion of the soap holder described herein is generally cylindrical, although this is not critical to the design of the soap holder. The base may have an hexagonal, square or other cross section as may be selected for esthetic reasons. The cap portion 4 is a generally convex shape which is also chosen primarily for esthetic purposes. The cap portion is necessary to enclose the end of the flexible arm 6 which is of sufficient length to hold the soap away from the soap holder. The cap portion should have a limited overhang over the cylindrical section so that the advantage of not using too much counter or bath side space is not lost.

The entire structure should be formed of a reasonably heavy material. The structure can be cast as a single piece of concrete, as two separate pieces (base 2 and cap 4 ) secured together by a pin or the like. The finished structure. may then be encased in plastic. The plastic is necessary so that the condition of the soap holder does not deteriorate from being wet, as will surely occur.

The flexible arm itself wich is a plastic covered wire should have a cap portion 10 on the end so that the soap holder 12 will not slide off the end of the arm 6. The weight of the soap holder is sufficient that no support frame on any wall, nor suction cups are necessary to keep the soap holder in its proper place.

Other variations on the preferred embodiment discussed above may become apparent to one of skill in the art who has studied the subject patent application. Therefore the scope of the present invention is to limited only by the following claims.

What is claimed is:

1. A device for supporting a bar of soap comprising a portable weighted base portion having a relative flat bottom configured to be freely supportable on a horizontal surface, a weighted upright columnar portion extending vertically from the base portion when the flat bottom is supported on the horizontal surface, a weighted cap portion and a support arm extending outwardly from said cap portion and substantially at right angles to the vertical axis of the columnar portion and of a length significantly greater than the cross-sectional width of said soap, said support arm being configured for engagement with a hook embedded in the soap to support said soap over a tub or basin.

2. A soap hanging device as claimed in claim 1 wherein said support arm is flexible.

3. A soap hanging device as claimed in claim 2 including a cap portion on the end of said arm for preventing said soap hook from sliding off said arm.

4. A soap hanging device as claimed in claim 3 wherein said columnar portion and said cap portion are plastic coated.

* * * * *